US008450946B1

(12) United States Patent
Lunn et al.

(10) Patent No.: US 8,450,946 B1
(45) Date of Patent: May 28, 2013

(54) ZONE ADDRESSING CIRCUIT FOR AN ELECTRONIC BALLAST

(75) Inventors: Thomas Lunn, Hazel Green, AL (US); Candice Damian, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 243 days.

(21) Appl. No.: 13/077,887

(22) Filed: Mar. 31, 2011

Related U.S. Application Data

(60) Provisional application No. 61/440,132, filed on Feb. 7, 2011.

(51) Int. Cl.
*H05B 41/24* (2006.01)
*G05F 1/00* (2006.01)

(52) U.S. Cl.
USPC ..... 315/307; 315/209 R; 315/247; 323/222; 323/283; 323/285; 363/16; 363/89

(58) Field of Classification Search
USPC ..... 315/158, 159, 209 R, 219, 254, 260–264, 315/291, 294, 295, 247, 307, 308, 312; 323/222, 323/283, 285; 363/89, 60, 61, 16, 17, 98
See application file for complete search history.

(56) References Cited

U.S. PATENT DOCUMENTS 4,523,128 A 6/1985 Stamm et al.
5,055,746 A 10/1991 Hu et al.
5,912,812 A * 6/1999 Moriarty, Jr. ..... 363/89
5,962,989 A * 10/1999 Baker ..... 315/294
6,670,779 B2 * 12/2003 Shen ..... 315/291
7,075,254 B2 * 7/2006 Chitta et al. ..... 315/307
7,279,854 B2 10/2007 Nerone
7,423,386 B2 * 9/2008 Radzinski et al. ..... 315/247
7,635,953 B2 * 12/2009 Tumula et al. ..... 315/94
7,821,237 B2 * 10/2010 Melanson ..... 323/222
7,852,014 B2 * 12/2010 Scollo et al. ..... 315/247
8,008,898 B2 * 8/2011 Melanson et al. ..... 323/222
8,198,874 B2 * 6/2012 Melanson ..... 323/222
8,212,493 B2 * 7/2012 Melanson et al. ..... 315/247

* cited by examiner

*Primary Examiner* — Vibol Tan
(74) *Attorney, Agent, or Firm* — Waddey & Patterson, P.C.; Mark J. Patterson; Gary L. Montle

(57) ABSTRACT

A zone addressing circuit is provided for an electronic ballast having a boost inductor with an auxiliary winding. The zone addressing circuit includes a first circuit branch coupled to a first addressing input terminal, a second circuit branch coupled to a second addressing input terminal, and a third (common) branch coupled on a first end to a third addressing input terminal and on a second end to the auxiliary winding of the boost inductor for providing a high frequency input pulse signal to excite the first and second branches. The first branch generates a first digital output for the zone addressing circuit when coupled to the common branch, and the second branch generates a second digital output for the zone addressing circuit when coupled to the common branch. A controller adjusts a dimming level of the ballast based on the first and second digital outputs from the zone addressing circuit.

20 Claims, 5 Drawing Sheets

ZONE ADDRESSING CIRCUIT FOR AN ELECTRONIC BALLAST

CROSS-REFERENCES TO RELATED APPLICATIONS

This application claims benefit of the following patent application(s) which is/are hereby incorporated by reference: U.S. Provisional Patent Application No. 61/440,132, filed Feb. 7, 2011.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present invention relates generally to dimming interface circuitry for electronic ballasts. More particularly, the present invention relates to various embodiments of a zone addressing circuit which detects input signal combinations from external sensors to control dimming levels for electronic ballasts.

Various systems and methods are presently available in the art for controlling dimming levels for electric light sources based on environmental conditions such as detected level of ambient light or occupancy in a given area. However, these systems and methods all too often cancel out beneficial cost savings by their very complexity. Interfaces are provided to the electronic ballasts that perform the dimming operation, adding installation and maintenance costs, and further often requiring external power in order to function properly. In addition, these interfaces can damage the electronic ballast itself when they are inadvertently connected to a mains power source during installation.

BRIEF SUMMARY OF THE INVENTION

A zone addressing circuit is provided in accordance with various embodiments of the present invention for detecting combinations of two wires to a third (common) wire to control dimming output levels for an electronic ballast.

In one aspect of the present invention, a high frequency signal is provided from existing circuitry in a common model electronic ballast to excite sense circuitry in the zone addressing circuit.

In another aspect of the present invention, the circuit has low-energy and non-dangerous shock hazard levels. The circuit also has very high impedance at mains power frequencies and is thereby configured to not damage the ballast when inadvertently coupled to line, neutral or ground input terminals.

In an embodiment of the present invention, a zone addressing circuit is provided for an electronic ballast having a boost inductor with an auxiliary winding. The zone addressing circuit includes a first circuit branch coupled to a first zone input terminal, a second circuit branch coupled to a second zone input terminal, and a third (common) branch coupled on a first end to a third zone input terminal and on a second end to the auxiliary winding of the boost inductor for exciting the first and second branches. The first branch generates a first digital output for the zone addressing circuit when coupled to the common branch, and the second branch generates a second digital output for the zone addressing circuit when coupled to the common branch. A controller adjusts a dimming level of the ballast based on the first and second digital outputs from the zone addressing circuit.

In another embodiment, an electronic ballast includes a boost inductor having an auxiliary winding. A zone addressing circuit includes first and third circuit branches coupled to a first addressing input terminal, second and fourth circuit branches coupled to a second addressing input terminal, and a capacitor coupled on a first end to a common input terminal and on a second end to the auxiliary winding of the boost inductor. A first digital output for the zone addressing circuit is generated from the first and second branches relative to the common input terminal. A second digital output for the zone addressing circuit is generated from the third and fourth branches relative to the common input terminal. A controller adjusts a dimming level of the ballast based on the first and second digital outputs from the zone addressing circuit.

In another embodiment, a zone addressing circuit is provided for an electronic ballast having a boost inductor with an auxiliary winding. The zone addressing circuit includes a first circuit branch with a first switching element coupled to a first addressing input terminal, a second circuit branch with a second switching element coupled to a second addressing input terminal, and a third circuit branch coupled on a first end to a third addressing input terminal and on a second end to the auxiliary winding of the boost inductor. Outputs from the first and second branches relative to the third branch in combination provide a multi-level analog output for the zone addressing circuit. A controller adjusts a dimming level of the ballast based on the first and second digital outputs from the zone addressing circuit.

DETAILED DESCRIPTION OF THE INVENTION

Figure 1:
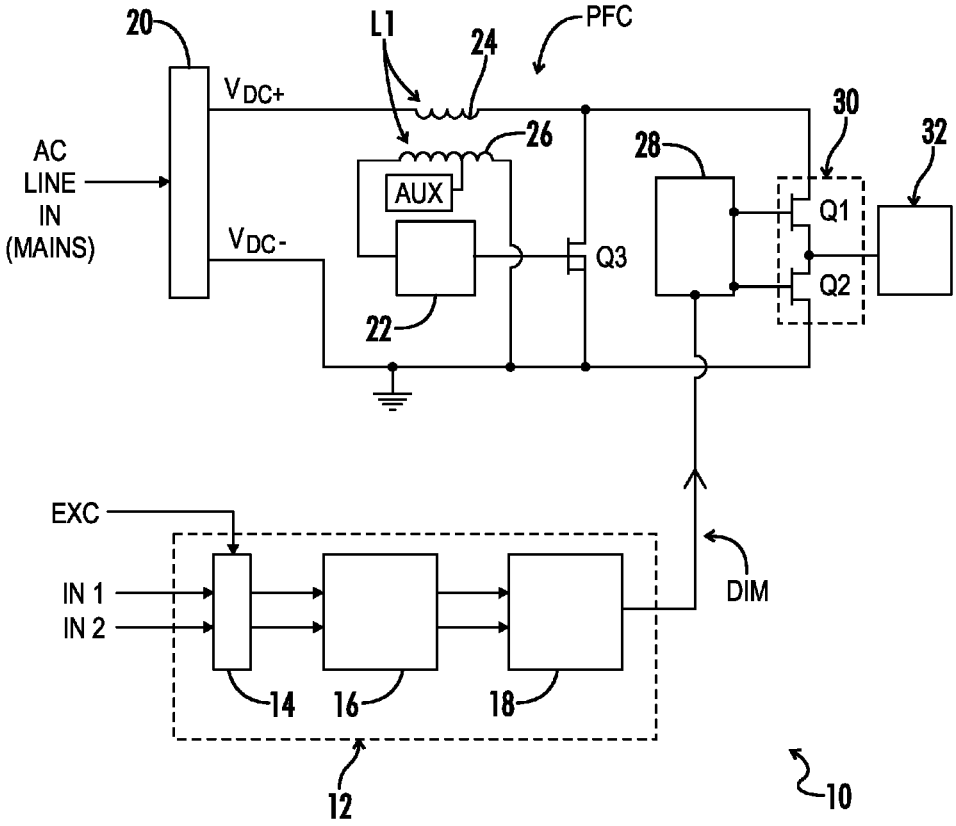
FIG. 1 is a circuit block diagram of an electronic ballast with a zone addressing circuit in accordance with various embodiments of the present invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data or other signal.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

Referring generally to FIGS. 1-5, various embodiments of an electronic ballast with dimming control circuitry including a zone addressing circuit are described herein. The zone addressing circuit of the present invention may be coupled to receive a plurality of input signals from external sensors representing environmental conditions such as, for example, an amount of lighting provided by sources other than one or more dimmable electric lighting devices being powered by the electronic ballast, and effective to provide one or more output signals associated with desired dimming control levels for the lighting devices.

As described in greater detail below, the present invention may in various embodiments be effective to control one or more lighting devices in a given area to a desired dimming level based on detected external conditions, or alternatively may be effective to control one or more of a plurality of lighting devices to different desired dimming levels based on detected external conditions in a given zone shared by the one or more lighting devices.

Where the various figures may describe embodiments sharing various common elements and features with other embodiments, similar elements and features are given the same reference numerals and redundant description thereof may be omitted below.

Referring first to FIG. 1, in various embodiments an electronic ballast 10 in accordance with the present invention may include a rectifier circuit 20 coupled to or otherwise arranged to receive an AC line input (power mains input) and to rectify the mains input into DC power input signals (Vdc+, Vdc−), a power factor correction circuit PFC, an inverter driver 28, an inverter 30 and a zone addressing circuit 12.

The PFC circuit as shown includes a boost inductor L1 having a first winding 24 coupled along the positive DC rail Vdc+. In one embodiment, a second (auxiliary) winding 26 provides an auxiliary signal AUX and is further coupled to a PFC controller 22 which among other functions is arranged to drive a PFC switching element Q3. The terms "switching element" and "switch" may be used interchangeably and may refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The inverter 30 includes a pair of switching elements Q1, Q2 arranged in a half-bridge configuration between the positive and negative DC rails Vdc+, Vdc− and driven by the inverter driver 28. In various embodiments alternative arrangements may be anticipated within the scope of the present invention, such as for example a full-bridge configuration or even a single microcontroller in place of the separate inverter switches and switch driver. The inverter driver 28 as shown is independently effective to drive the inverter switches in accordance with a received dimming control signal DIM. In various embodiments a separate controller (not shown) may be provided to receive the dimming control signal and generate, for example, a pulse-width modulated PWM signal to regulate operation of a dedicated switch driver, or alternatively a single controller may include and otherwise provide each of the above functions.

The terms "control circuit" or "controller" as used herein may refer to at least a general microprocessor, an application specific integrated circuit (ASIC), a digital signal processor (DSP), a microcontroller, a field programmable gate array, or various alternative blocks of discrete circuitry as known in the art, designed to perform functions as further defined herein.

The inverter 30 may generally be effective to power a load 32, which includes a gas discharge electric lighting circuit and associated circuitry as known to those of skill in the art such as for example a resonant circuit, various lighting detection circuitry to provide feedback signals to the switch driver, etc.

A zone addressing circuit 12 in accordance with various embodiments of the present invention includes an input circuit 14, sense circuitry 16, and a dimming control circuit 18 responsive to one or more output signals from the sense circuitry 16 to produce a dimming control signal DIM to the inverter driver 28 (or associated microcontroller). While the input circuit 12, sense circuitry 14 and control circuit 18 as described herein take the form of discrete circuit components, it may be anticipated that in various embodiments within the scope of the present invention the various functions of the zone addressing circuit 12 may be implemented by alternative circuitry and combinations thereof.

The input circuit 14 as shown may include circuitry effective to receive a power input signal EXC on a common wire so as to excite the sense circuitry 16 when it is coupled to the common wire based on input signals IN1, IN2 from external lighting detection sources. In one embodiment, the state of the zone inputs IN1, IN2 may correspond to an open/closed input condition in response to externally detected lighting conditions as represented by output signals from associated external sensors (not shown). The power input signal EXC may be a high-frequency pulse signal which is provided to excite the sense circuitry 16 wherein pulsed input signals are provided to the circuitry 16 in conjunction with a state of the zone inputs IN1, IN2 (i.e., open, closed).

The input circuit 14 may include for example relays, switching elements or the like which open/close in response to or otherwise based on input signals from the external sensors to couple and de-couple the various circuit branches of the sense circuitry 16 from the excitation signal EXC on common wire branch. Various alternatives may be comprehended by one of skill in the art, and such circuitry being well known requires no further explanation herein.

The external sensors may in various examples be lighting sensors, motion or occupancy sensors, noise sensors, dual technology sensors, or any type which may be effective to provide inputs to the zone addressing circuit effective to regulate or otherwise determine a desired dimming level for the associated one or more electronic ballasts.

In certain embodiments the detected external conditions may accordingly in a first example be lighting conditions in separate locations associated with lighting sources to be dimmed when such locations are well lit with ambient light.

Alternatively, in a second example the external sensors may be for example a lighting sensor and an occupancy sensor (or virtually any equivalent combination), in which case the dimming control circuit may be configured to implement one or more dimming operation modes based on a particular sequence of and/or predetermined times between various externally provided inputs to the dimming control circuitry.

Figure 2:
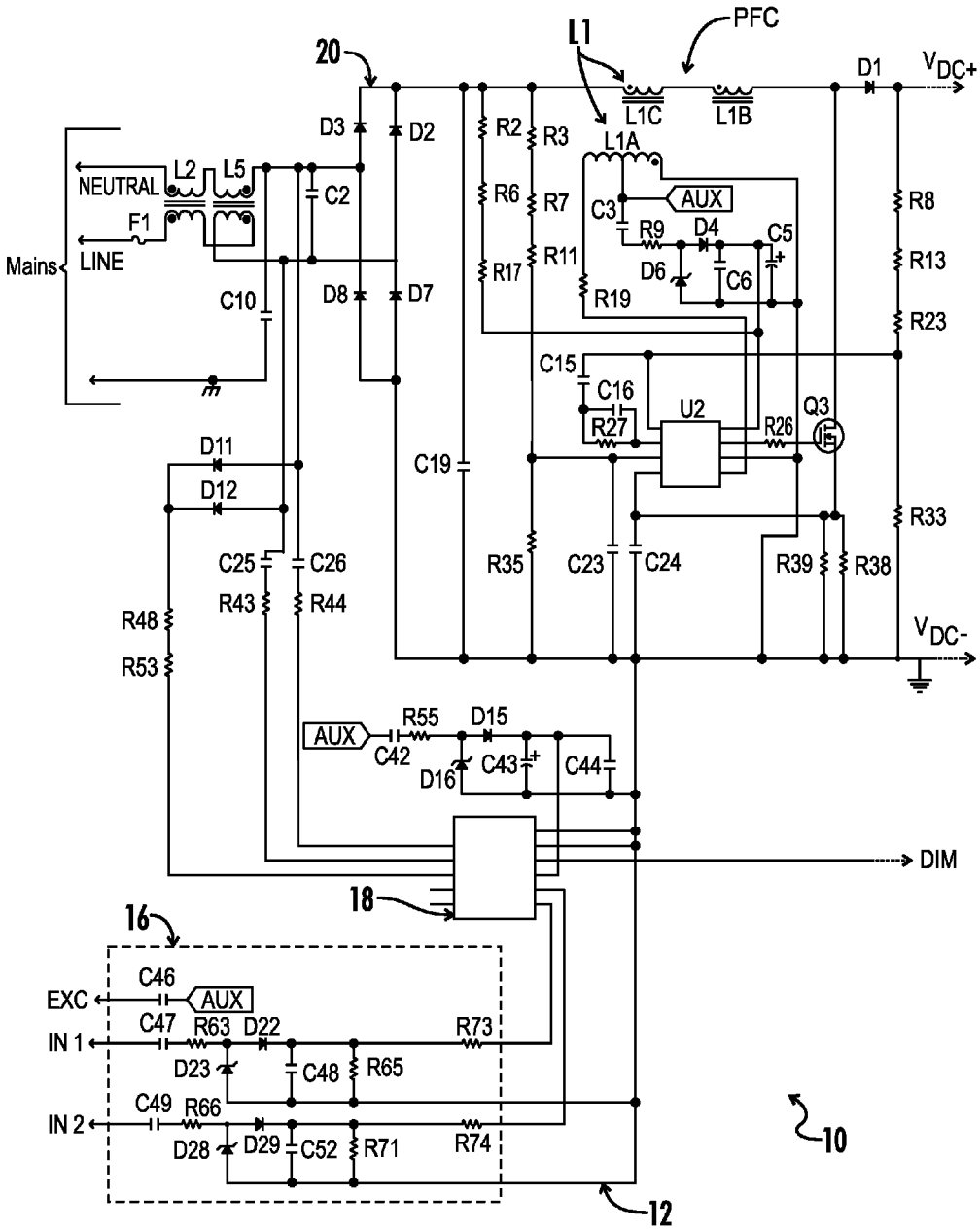
FIG. 2 is a circuit diagram of an embodiment of the ballast and zone addressing circuit of FIG. 1.

Referring now to FIG. 2, in one embodiment the power input signal EXC to the zone addressing circuit 12 may be provided via a high frequency signal AUX from the auxiliary winding L1A of the boost inductor L1 (labeled 26 in FIG. 1) as sourced through a capacitor C46 (having for example values of 1.0 nF, 1.0 kV) on the common wire. In such a configuration the sense circuitry 16 may be sufficiently excited using a signal that is already available in the electronic ballast 10.

Various embodiments of sense circuitry 16 in accordance with the present invention may now be described with reference to FIGS. 3-5, respectively.

Figure 3:
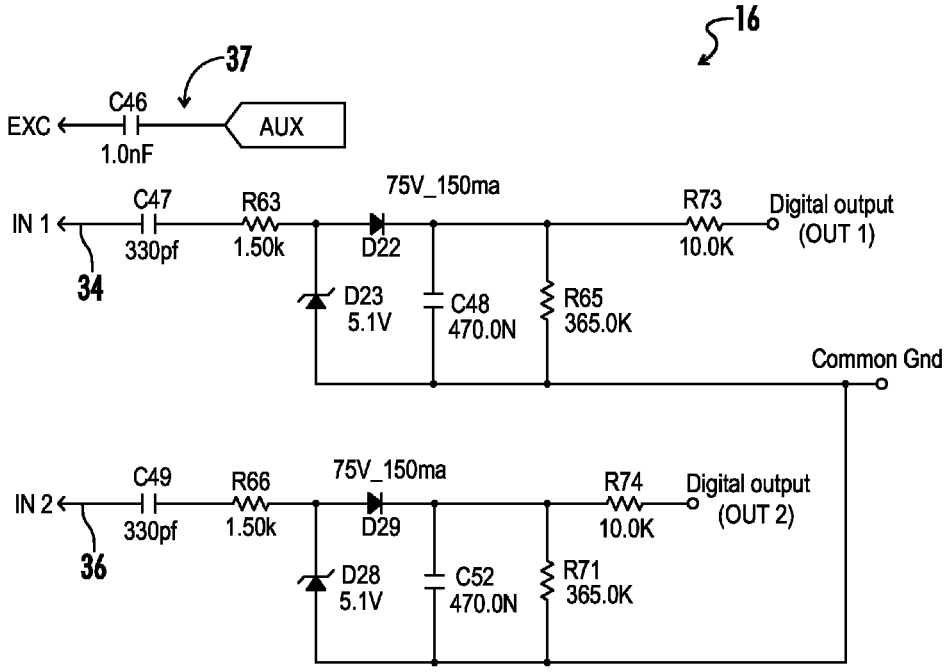
FIG. 3 is a circuit diagram of an embodiment of the zone addressing circuit of FIG. 1.

In an embodiment as represented in FIG. 3, a particular configuration of the sense circuitry 16 is effective to generate first and second digital logic outputs OUT1, OUT2 by which the control circuit 18 can detect any of four zone addresses depending on the combination of logic ones and logic zeros provided. The sense circuitry 16 as shown includes a first circuit branch 34 having a first sensing wire coupled to a first input terminal to receive the first zone input IN1, and a second circuit branch 36 having a second sensing wire coupled to a second input terminal to receive the second zone input IN2. The first sensing wire 34 is coupled to a capacitor C47 (having values of 330 pF, 1 kV in an embodiment as shown but without being expressly limited to such a particular configuration) that feeds a charge pump circuit (for example, resistors R63, R65, R73, capacitor C48 and diodes D22, D23 as shown) effective to generate a high frequency pulse output when connected to the common wire 37 (or in other words a common circuit branch 37 with respect to the first and second branches) across which the excitation signal is provided.

The second sensing wire 36 is coupled to a capacitor C49 and charge pump circuit having substantially the same configuration and function.

The sense circuitry 16 as configured in FIG. 3 may accordingly generate four combinations of logical outputs as logic ones and logic zeros corresponding to the providing of high frequency pulses (i.e., 0,0; 0,1; 1,0; 1,1) to the dimming control circuit 18, by which the dimming control circuit 18 may detect various desired dimming levels. As but one example, where two logic ones are generated, the dimming control circuit 18 may be programmed to recognize that minimal dimming is desired or required by the electronic ballast, and where two logic zeros are generated that a maximum amount of dimming is to be provided. The mixed logic outputs (i.e., 0,1; 1,0) may correspond with intermediate levels of dimming control, depending on the locations of the external sensors responsible for the corresponding logic signals. The inverse is of course also possible with regards to the minimal and maximum dimming corresponding to a pair of logic zeros and logic ones, respectively.

The sense circuitry 16 in certain embodiments such as shown for example in FIG. 3 may be further effective to provide a high impedance at a mains power frequency, wherein the electronic ballast is protected from inadvertent coupling of the zone addressing circuit 12 to the mains power source. As previously stated, the circuit component values may vary in accordance with the present invention to perform this protection function.

Figure 4:
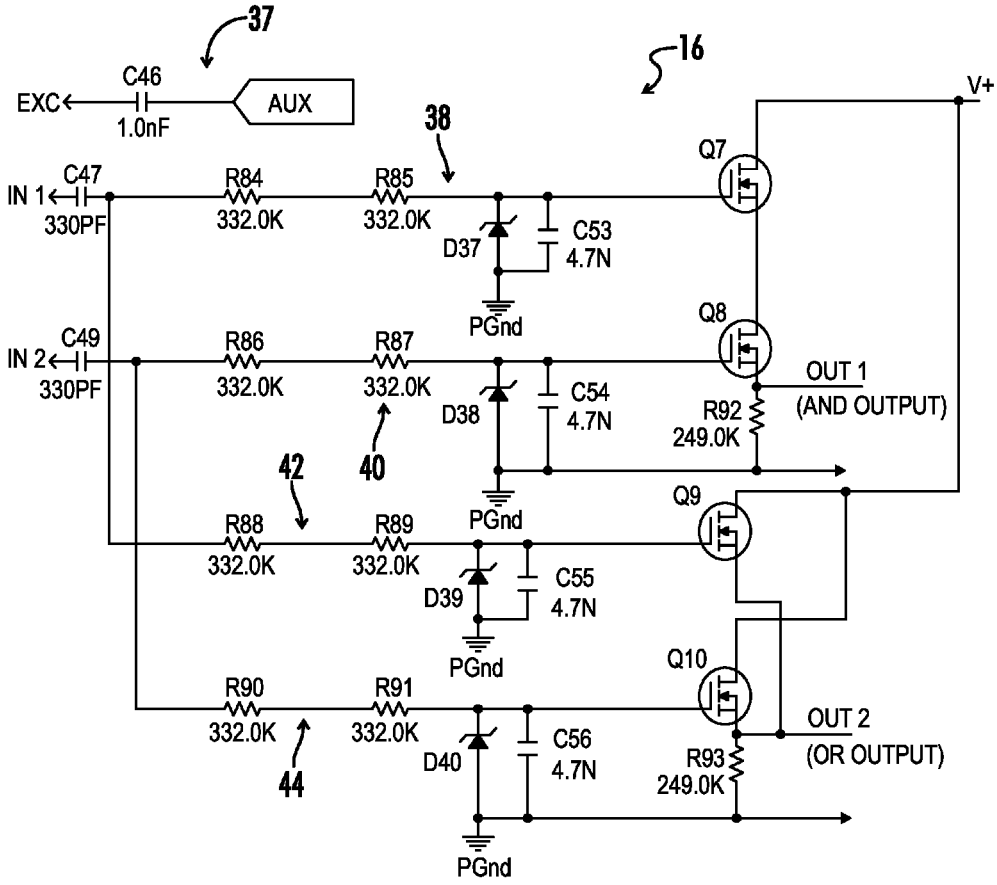
FIG. 4 is a circuit diagram of another embodiment of the zone addressing circuit of FIG. 1.

In an embodiment as represented in FIG. 4, another configuration of the sense circuitry 16 is effective to generate first and second digital logic outputs OUT1, OUT2 by which the dimming control circuit 18 (FIG. 1) can detect any of three zone addresses depending on the combination of logic ones and logic zeros provided. The sense circuitry 16 as shown includes a first circuit branch 38 coupled to a capacitor C47 (having values of 330 pF, 1 kV in an embodiment as shown but without being expressly limited to such a particular configuration) further coupled to a first input terminal to receive the first zone input IN1, a second circuit branch 40 coupled to a capacitor C49 (also having an exemplary value of 330 pF) further coupled to a second input terminal to receive the second zone input IN2, a third circuit branch 42 coupled to the first circuit branch 38 and the capacitor C47 to receive the first zone input IN1, and a fourth circuit branch 44 coupled to the second circuit branch 40 and the capacitor C49 to receive the second zone input IN2.

The first circuit branch 38 in an embodiment as shown includes a pair of resistors R84, R85 coupled in series between the first input terminal and the gate of a switching element Q7. A diode D37 and capacitor C53 are coupled in parallel on a first end to ground and on a second end to a node between the resistors R84, R85 and the gate of switching element Q7. The second circuit branch 40 has substantially the same configuration, and is arranged in parallel with the first circuit branch 38, with the switching element Q7 from the first branch 38 coupled in series with the switching element Q8 from the second branch 40 between a positive voltage source V+ and power ground. Each branch 38, 40 is effective to generate a high frequency pulse output having an amplitude greater than the threshold voltage of the respective switching elements when connected to the common wire (or in other words a common circuit branch with respect to the first and second branches) across which the excitation signal is provided. A first output signal OUT1 is provided from a node between the switching element Q8 from the second branch 40 and power ground, and represents a logic AND output from the sense circuitry 16.

The third and fourth circuit branches 42, 44 each have substantially the same configuration as the first branch 38, and are arranged in parallel with each other, with the sources of a switching element Q9 from the third branch 42 and a switching element Q10 from the fourth branch 44 coupled to the positive voltage source V+, and the drains of the switching elements Q9, Q10 coupled to each other and to power ground. Each branch 42, 44 is effective to generate a high frequency pulse output having an amplitude greater than the threshold voltage of the respective switching elements when connected to the common wire (or in other words a common circuit branch with respect to the third and fourth branches) across which the excitation signal is provided. A second output signal OUT2 is provided from a node between the drains of the switching elements Q9, Q10 and power ground, and represents a logic OR output from the sense circuitry 16.

The sense circuitry 16 in such a configuration may generate three combinations of logical outputs as logic ones and logic zeros corresponding to the providing of high frequency pulses (i.e., 0,0; 0,1; 1,1) to the dimming control circuit 18, by which the dimming control circuit 18 may detect various desired dimming levels. In this example, where two logic ones are generated (indicating a logic AND with respect to the circuit branches), the dimming control circuit 18 may be programmed to recognize that minimal dimming is desired or required by the electronic ballast, where two logic zeros are generated that a maximum amount of dimming is to be provided, and where only one logic one is generated (indicating a logic OR with respect to the circuit branches) that an intermediate dimming level is desired.

Figure 5:
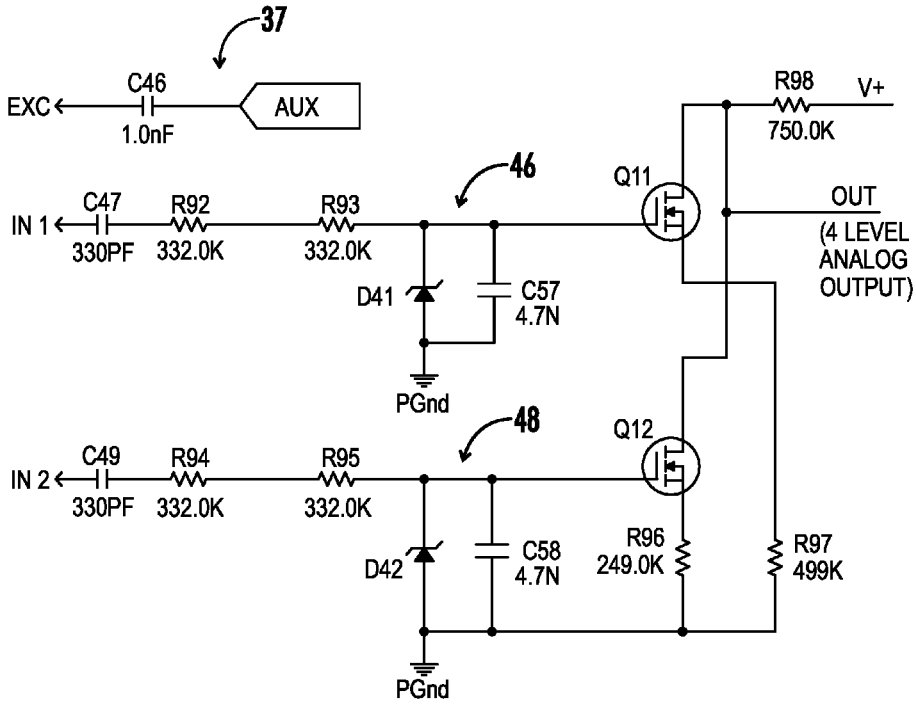
FIG. 5 is a circuit diagram of another embodiment of the zone addressing circuit of FIG. 1.

In an embodiment as represented in FIG. 5, another configuration of the sense circuitry 16 is effective to generate a single four-level analog output OUT by which the control circuit 18 can detect any of four associated zone addresses. The sense circuitry 16 as shown includes a first circuit branch 46 coupled to a capacitor C47 further coupled to a first input terminal to receive the first zone input IN1 and a second circuit branch 48 coupled to a capacitor C49 further coupled to a second input terminal to receive the second zone input IN2.

The first circuit branch 46 includes a pair of resistors R92, R93 coupled in series between the first input terminal and the gate of a switching element Q11. A diode D41 and capacitor C57 are coupled in parallel on a first end to power ground and on a second end to a node between the resistors R92, R93 and the gate switching element Q11. The source of the switching element Q11 is coupled to the positive voltage source V+ and the drain is coupled to power ground via a resistor R97 having a first value (e.g., 750 k-ohms).

The second circuit branch 48 has substantially the same configuration, and is arranged in parallel with the first circuit branch 46, with the source of the switching element Q12 from the second branch 48 coupled to the positive voltage source V+ and the drain coupled to power ground via resistor R96 having a second value (e.g., 250 k-ohms).

Each branch 46, 48 is effective to generate a high frequency pulse output having an amplitude greater than the threshold voltage of the respective switching elements when connected to the common wire (or in other words a common circuit branch with respect to the first and second branches) across which the excitation signal is provided. An output signal OUT is provided from a node coupled to the sources of each switching element Q11, Q12, and has an analog value corresponding to the combination of branches 46, 48 which is/are presently excited. An analog output from the first branch 46 in this example would be different from an analog output from the second branch 48, given the disparity in resistance values for each branch between the positive source V+ and power ground. Therefore, in addition to a maximum (or minimum) dimming control level which would be detected by the dimming control circuit 18 when both branches 46, 48 are excited, and a minimum (or maximum) dimming control level detected by the dimming control circuit 18 when neither branch is excited, the dimming control circuit 18 may further be programmed to recognize two intermediate dimming control levels associated with either of the first 46 or the second circuit branch 48 being excited exclusively of the other, based upon a received analog output signal OUT.

In certain embodiments in accordance with the present invention, it may be anticipated that additional input signals and associated sense circuit branches may be provided, with a corresponding increase in the number of logic combinations and dimming control levels.

In various embodiments a single dimming control circuit may provide dimming control signals that, rather than provide a plurality of dimming control levels to one or more electronic ballasts, may provide individual dimming signals to one or more electronic ballasts corresponding with individual zones of lighting devices for which lighting is desired or otherwise at a particular time of day or the like.

The previous detailed description has been provided for the purposes of illustration and description. Thus, although there have been described particular embodiments of the present invention of a new and useful "Zone Addressing Circuit for an Electronic Ballast," it is not intended that such references be construed as limitations upon the scope of this invention except as set forth in the following claims.

What is claimed is:

1. An electronic ballast comprising:

a boost inductor having an auxiliary winding;

a zone addressing circuit comprising a first circuit branch coupled to a first input terminal, a second circuit branch coupled to a second input terminal, and a third circuit branch coupled on a first end to the auxiliary winding of the boost inductor and effective to provide high frequency pulse signals when coupled on a second end to either or both of the first and second circuit branches;

an output from the first branch when coupled to the third branch comprising a first digital output for the zone addressing circuit, and an output from the second branch when coupled to the third branch comprising a second digital output for the zone addressing circuit; and a controller effective to control a dimming level of the ballast based on a combination of the first and second digital outputs from the zone addressing circuit.

2. The ballast of claim 1, the third circuit branch comprising a sourcing capacitor further coupled to the auxiliary winding and effective to source a high frequency signal from the auxiliary winding.

3. The ballast of claim 2, the first circuit branch comprising a first charge pump capacitor coupled to the first input terminal and a first charge pump circuit fed by stored energy from the first charge pump capacitor and effective to generate a logic one output when the first circuit branch is coupled to the third circuit branch.

4. The ballast of claim 3, the second circuit branch comprising a second charge pump capacitor coupled to the second input terminal and a second charge pump circuit fed by stored energy from the second charge pump capacitor and effective to generate a logic one output when the second circuit branch is coupled to the third circuit branch.

5. The ballast of claim 4, the first and second charge pump circuits having circuitry effective to provide a high impedance at a mains power frequency, wherein the electronic ballast is protected from inadvertent coupling of the zone addressing circuit to a mains power source.

6. The ballast of claim 5, the controller further coupled to receive mains input signals from a mains power source and effective to control a dimming level of the ballast based at least in part on the first and second digital outputs from the zone addressing circuit and the mains input signals.

7. An electronic ballast comprising:

a boost inductor having an auxiliary winding;

a zone addressing circuit comprising first and third circuit branches coupled to a first addressing input terminal, and second and fourth circuit branches coupled to a second addressing input terminal;

a capacitor coupled on a first end to a common input terminal of the zone addressing circuit and on a second end to the auxiliary winding of the boost inductor;

an output from the first branch and second branches relative to the common input terminal comprising a first digital output for the zone addressing circuit, and an output from the third and fourth branches relative to the common input terminal comprising a second digital output for the zone addressing circuit; and a controller effective to control a dimming level of the ballast based on a combination of the first and second digital outputs from the zone addressing circuit.

8. The ballast of claim 7, the first digital output from the zone addressing circuit comprising a logic AND output based on input signals provided to the first and second addressing input terminals.

9. The ballast of claim 8, the second digital output from the zone addressing circuit comprising a logic OR output based on input signals provided to the first and second addressing input terminals, the controller effective to detect one of four predetermined dimming levels based on the first and second digital outputs.

10. The ballast of claim 9, the first circuit branch comprising a first switching element having a gate coupled to the first addressing input terminal, the second circuit branch comprising a second switching element having a gate coupled to the second addressing input terminal and a drain coupled to the source of the first switching element.

11. The ballast of claim 10, the third circuit branch comprising a third switching element having a gate coupled to the first addressing input terminal, the fourth circuit branch comprising a fourth switching element having a gate coupled to the second addressing input terminal and a drain coupled to the drain of the third switching element, a source of the third switching element being further coupled to the source of the fourth switching element.

12. The ballast of claim 11, the circuit branches further comprising circuitry effective to provide a high impedance at a mains power frequency, wherein the electronic ballast is protected from inadvertent coupling of the zone addressing circuit to a mains power source.

13. The ballast of claim 12, the controller further coupled to receive mains input signals from a mains power source and effective to control a dimming level of the ballast based at least in part on the digital logic outputs from the zone addressing circuit and the mains input signals.

14. An electronic ballast comprising:

a boost inductor having an auxiliary winding;

a zone addressing circuit comprising a first circuit branch coupled to a first addressing input terminal and comprising a first switching element, a second circuit branch coupled to a second addressing input terminal and comprising a second switching element, and a third circuit branch coupled on a first end to a third addressing input terminal and on a second end to the auxiliary winding of the boost inductor;

outputs from the first and second branches relative to the third branch comprising in combination a multi-level analog output for the zone addressing circuit; and a controller effective to control a dimming level of the ballast based at least in part on the multi-level analog output from the zone addressing circuit.

15. The ballast of claim 14, the third circuit branch comprising a sourcing capacitor further coupled to the auxiliary winding and effective to source a high frequency signal from the auxiliary winding.

16. The ballast of claim 15, the first switching element having a gate coupled to the first addressing input terminal, a source coupled to power ground via a first resistance, and a drain coupled to a reference voltage source, wherein an excitation signal applied to the gate of the first switching element from the third circuit branch provides a first voltage value at a first node coupled to the drain of the first switching element and with respect to ground.

17. The ballast of claim 16, the second switching element having a gate coupled to the second addressing input terminal, a source coupled to power ground via a second resistance, and a drain coupled to the reference voltage source, wherein an excitation signal applied to the gate of the second switching element from the third circuit branch provides a second voltage value at the first node and with respect to ground.

18. The ballast of claim 17, the multi-level analog output for the zone addressing circuit having values associated with neither of the first and second switching elements being on, both of the first and second switching elements being on, only the first switching element being on, and only the second switching element being on.

19. The ballast of claim 18, the first and second circuit branches having circuitry effective to provide a high impedance at a mains power frequency, wherein the electronic ballast is protected from inadvertent coupling of the zone addressing circuit to a mains power source.

20. The ballast of claim 19, the controller further coupled to receive mains input signals from a mains power source and effective to control a dimming level of the ballast based on the analog output from the zone addressing circuit and the mains input signals.

* * * * *